US009956440B2

(12) United States Patent
Werjefelt

(10) Patent No.: US 9,956,440 B2
(45) Date of Patent: May 1, 2018

(54) OXYGEN SUPPLY WITH CARBON DIOXIDE SCRUBBER FOR EMERGENCY USE

(71) Applicant: Bertil R. L. Werjefelt, Kaneohe, HI (US)

(72) Inventor: Bertil R. L. Werjefelt, Kaneohe, HI (US)

( * ) Notice: Subject to any disclaimer, the term of this patent is extended or adjusted under 35 U.S.C. 154(b) by 0 days. days.

(21) Appl. No.: 14/594,967

(22) Filed: Jan. 12, 2015

(65) Prior Publication Data

US 2015/0202472 A1 Jul. 23, 2015

Related U.S. Application Data

(60) Provisional application No. 61/926,740, filed on Jan. 13, 2014.

(51) Int. Cl.

| | |
|---|---|
| ***A62B 7/14*** | (2006.01) |
| ***A62B 19/00*** | (2006.01) |
| *A62B 18/02* | (2006.01) |

(52) U.S. Cl.

CPC ..... *A62B 19/00* (2013.01); *A62B 7/14* (2013.01); *A62B 18/02* (2013.01)

(58) Field of Classification Search

CPC .... A62B 7/10; A62B 7/12; A62B 7/14; A62B 9/006; A62B 9/02; A62B 9/022; A62B 18/02; A62B 18/08; A62B 18/088; A62B 18/10; A62B 19/00; A62B 7/06; A62B 7/00; A62B 18/00

See application file for complete search history.

(56) References Cited

U.S. PATENT DOCUMENTS

| | | | | | |
|---|---|---|---|---|---|
| 1,625,419 | A * | 4/1927 | McCaa | A62B 7/10 | 128/202.22 |
| 3,577,988 | A * | 5/1971 | Jones | B63C 11/24 | 128/201.25 |
| 3,604,416 | A * | 9/1971 | Petrahai | A62B 7/10 | 128/201.25 |
| 3,942,524 | A * | 3/1976 | Li | A62B 7/08 | 128/202.26 |
| 3,976,063 | A * | 8/1976 | Henneman | A62B 7/10 | 128/201.25 |
| 4,164,218 | A * | 8/1979 | Martin | A62B 7/08 | 128/201.18 |

(Continued)

FOREIGN PATENT DOCUMENTS

| | | | | |
|---|---|---|---|---|
| EP | 0453926 | 7/1996 | | |
| JP | 3921295 | 5/2007 | | |
| JP | 3921295 B2 * | 5/2007 | | A62B 7/02 |

OTHER PUBLICATIONS

International Searching Authority, International Search Report and the Written Opinion of the International Searching Authority, dated Apr. 13, 2015, PCT/US15/11058.

*Primary Examiner* — Peter S Vasat

(74) *Attorney, Agent, or Firm* — Shlesinger, Arkwright & Garvey LLP

(57) ABSTRACT

An oxygen supply system for a station operator includes an oxygen cylinder; a mask operably connected to the oxygen cylinder; a pouch operably connected to the mask; carbon dioxide scrubber disposed inside the pouch; first one-way valve operably connected between the mask and the pouch for allowing one-way flow of gases exhaled by the operator from the mask to the pouch; and second one-way valve operably connected between the mask and the pouch for allowing one-way flow of gases from the pouch to the operator.

19 Claims, 6 Drawing Sheets

(56) References Cited

U.S. PATENT DOCUMENTS 4,231,118 A * 11/1980 Nakagawa ..... A62B 17/04 128/201.25
4,502,876 A * 3/1985 Behnke, Jr. ..... A62B 19/00 55/516
4,821,711 A * 4/1989 Eckstein ..... A62B 9/003 128/202.26
4,917,081 A * 4/1990 Bartos ..... A62B 9/02 128/205.12
5,056,512 A * 10/1991 Bower ..... A62B 17/04 128/201.25
5,119,808 A * 6/1992 Marquardt ..... A62B 17/04 128/201.22
5,165,394 A * 11/1992 Hochberg ..... A62B 7/10 128/201.25
5,165,399 A * 11/1992 Hochberg ..... B01D 53/62 128/205.12
5,222,479 A * 6/1993 Brauer ..... A62B 7/08 128/202.26
H1360 H * 10/1994 Grove et al. ..... A62B 17/04 128/201.23
5,360,002 A * 11/1994 Smith ..... A61M 16/22 128/205.12
5,706,799 A * 1/1998 Imai ..... A62B 7/08 128/205.11
6,279,571 B1 * 8/2001 Meckes ..... A62B 17/04 128/201.22
6,340,024 B1 * 1/2002 Brookman ..... A62B 17/04 128/201.15
7,814,904 B2 * 10/2010 Resnick ..... A62B 17/04 128/201.22
8,272,381 B2 * 9/2012 Johnson ..... B63C 11/24 128/201.27
8,302,603 B1 * 11/2012 Weber ..... A62B 7/02 128/204.18
8,678,001 B2 * 3/2014 Cowgill ..... A62B 7/08 128/205.17
2007/0163591 A1 * 7/2007 Ross ..... A62B 7/08 128/205.12
2011/0277768 A1 * 11/2011 Hill ..... A62B 7/10 128/205.28
2012/0048275 A1 * 3/2012 Cowgill ..... A62B 7/10 128/205.28

* cited by examiner

OXYGEN SUPPLY WITH CARBON DIOXIDE SCRUBBER FOR EMERGENCY USE

RELATED APPLICATION

This is a nonprovisional application of provisional application Ser. No. 61/926,740, filed Jan. 13, 2014, the priority of which is hereby claimed and the disclosure of which is hereby incorporated by reference.

FIELD OF THE INVENTION

The present invention is generally directed to providing an oxygen supply to a station operator during an emergency requiring the use of the oxygen supply and in particular to a lightweight system for extending the oxygen supply normally provided onboard aircrafts for crewmembers.

SUMMARY OF THE INVENTION

The present invention provides an oxygen supply system for a station operator, comprising an oxygen mask for being operably connected to an oxygen cylinder; a pouch operably connected to the oxygen mask; carbon dioxide scrubber disposed inside the pouch; a first one-way valve operably connected between the oxygen mask and the pouch for allowing one-way flow of gases exhaled by the operator from the oxygen mask to the pouch; and a second one-way valve operably connected between the oxygen mask and the pouch for allowing one-way flow of gases from the pouch to the operator.

The present invention also provides an oxygen mask, comprising a cup for sealing attachment over a user's mouth and nose, the cup being connected to an oxygen supply for breathing by the user; a pouch operably connected to the cup; carbon dioxide scrubber disposed inside the pouch; a first one-way valve operably connected between the cup and the pouch for allowing one-way flow of gases exhaled by the user to the pouch; and a second one-way valve operably connected between the cup and the pouch for allowing one-way flow of gases from the pouch to the cup.

DETAILED DESCRIPTION OF THE INVENTION

Figure 1:
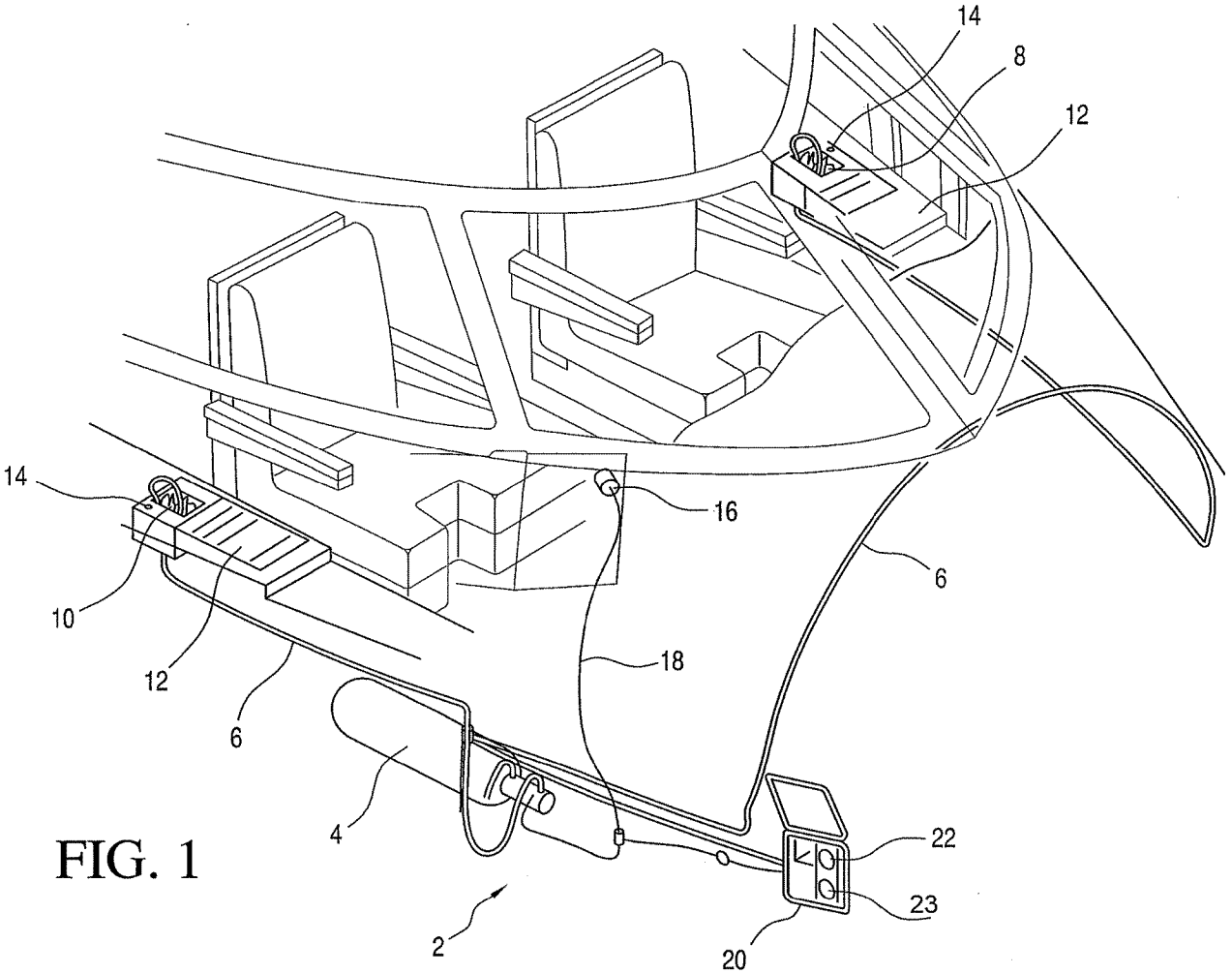
FIG. 1 shows a schematic diagram of a layout of an oxygen supply in an aircraft.

Referring to FIG. 1, a conventional oxygen supply system 2 for an aircraft cockpit is shown. An oxygen tank 4 supplies oxygen through low-pressure tubings 6 to a pilot mask 8 and a co-pilot mask 10 stowed in respective consoles 12 when not in use. Each console 12 has an oxygen flow indicator 14 when oxygen is flowing to the masks. An oxygen pressure gauge 16 is connected to the oxygen tank 4 via high pressure tubing 18. The gauge 16 provides information to the pilot or co-pilot on the amount oxygen remaining in the tank 4. A ground service panel 20 with a filler valve 22 and a gauge 23 is provided for ground servicing of the oxygen tank 4.

Figure 2:
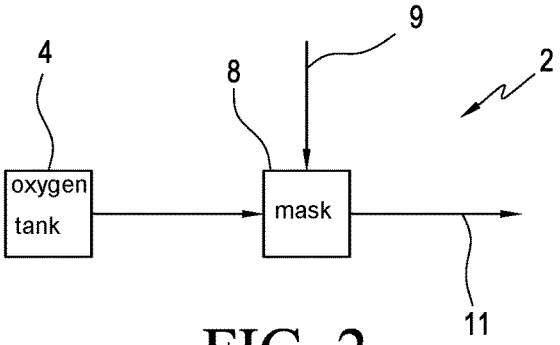
FIG. 2 is a schematic flow diagram showing an open circuit supplementary oxygen supply for decompression.
Figure 3:
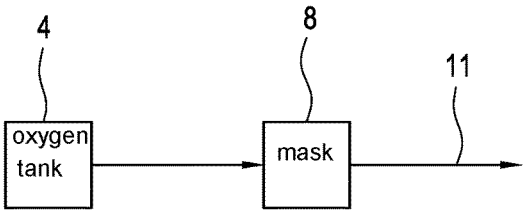
FIG. 3 is a schematic flow diagram showing an open circuit 100% oxygen supply for use during decompression, smoke or other emergencies.

Referring to FIGS. 2 and 3, the oxygen supply system 2 during use is schematically disclosed for the pilot oxygen mask 8, although the diagrams are equally applicable to the co-pilot oxygen mask 10. Accordingly, it should be understood that the following description is also applicable to the co-pilot oxygen mask 10.

Referring to FIG. 2, the discharge rate from the oxygen tank 4 is set at lower than 100% oxygen level through a standard regulator on the oxygen mask when ambient air 9 is usable for breathing for the pilot. Unabsorbed oxygen by the lungs, air and carbon dioxide are exhaled by the pilot to the outside at 11.

Referring to FIG. 3, the discharge rate from the oxygen tank 4 is set at 100% oxygen so that the pilot breathes in 100% oxygen from the oxygen tank 4 through the oxygen mask 8. This setting is used when ambient air is contaminated with smoke or otherwise not fit for breathing. The oxygen rate of discharge is regulated through the regulator on the oxygen mask. Unabsorbed oxygen by the lungs and carbon dioxide are exhaled by the pilot to the outside at 11. The remaining oxygen in the tank 4 is monitored through the oxygen pressure gauge 16.

Figure 4:
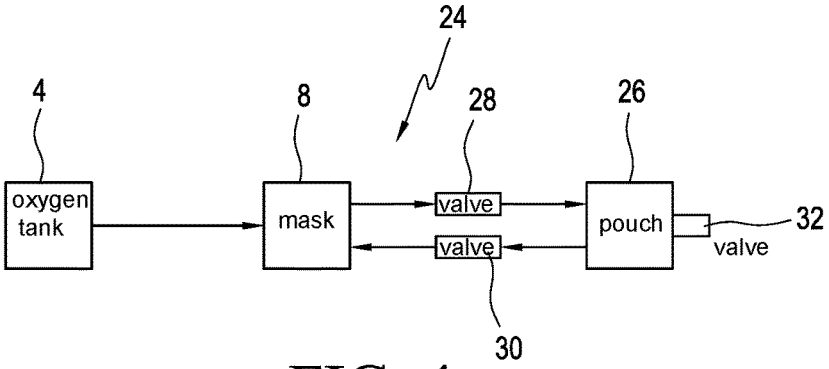
FIG. 4 is a schematic flow diagram showing a closed circuit oxygen supply using carbon dioxide scrubber for use during decompression, smoke or other emergencies in accordance with the present invention.

Referring to FIG. 4, an oxygen supply system 24 made in accordance with the present invention for a station operator, such as a pilot or co-pilot in an aircraft cockpit, is disclosed. The oxygen tank 4 provides 100% oxygen to the operator through the oxygen mask 8. The operator exhales unabsorbed oxygen and carbon dioxide to a pouch 26 containing carbon dioxide scrubber, such as LiOH, through a one-way valve 28. The unabsorbed oxygen and carbon dioxide exhaled by the operator will accumulate inside the pouch 26. The carbon dioxide scrubber will absorb the carbon dioxide and thus reduce the amount of carbon dioxide in the gas inside the pouch 26. Instead of the unabsorbed oxygen being exhaled to the outside environment, the unabsorbed exhaled oxygen is advantageously collected in the pouch 26. The pouch 26 initially will be in a folded position. As the operator exhales into the pouch 26, pressure will build up inside to inflate the pouch.

Once the oxygen supply 4 is getting nearly used up, the operator will open a one-way valve 30 to allow the accumulated oxygen in the pouch 26 to flow to the oxygen mask 8. In this configuration, the valve 30 is normally closed until manually opened by the operator. Instead of the unabsorbed oxygen being exhaled to the environment and being wasted, it is allowed to accumulate inside the pouch 26. A relief valve 32 may be provided to relieve pressure buildup within the pouch 26.

Preferably, the oxygen tank 4 may be set at a lower rate of discharge than at the 100% oxygen setting when the pouch 26 is inflated and full of exhaled gases. The oxygen collected in the pouch 26 is then used to supplement the reduced oxygen rate from the tank 4. In this mode of operation, the valve 30 would be opened in the direction indicated by the arrows to allow the operator to breathe in the oxygen collected in the pouch 26. The oxygen from the oxygen tank 4 mixes with the oxygen from the pouch 26 to provide sufficient oxygen to the operator.

The one-way valve 30 may be incorporated in the oxygen mask and may be controlled by the operator.

In either way of operation, allowing the oxygen tank 4 to nearly run out before using the oxygen in the pouch 26, or mixing the oxygen from the tank 4 with the oxygen from the pouch 26, the system 24 advantageously extends the duration during which oxygen is supplied by the oxygen tank 4 with little weight penalty to the aircraft.

Figure 5:
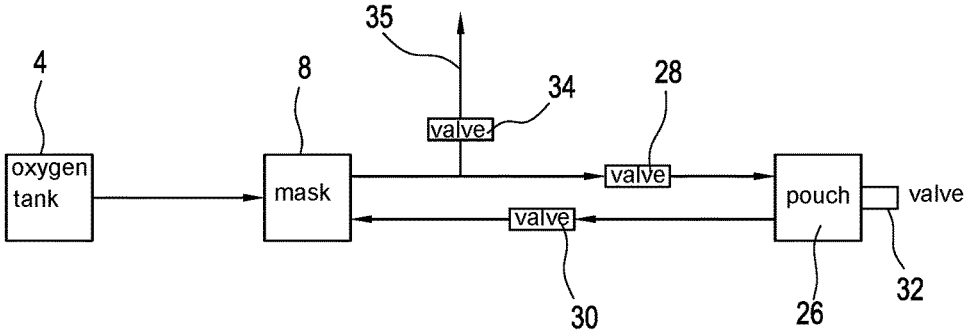
FIG. 5 is a schematic diagram of another embodiment of a closed circuit oxygen supply using carbon dioxide scrubber for use during decompression, smoke or other emergencies in accordance with the present invention.

Referring to FIG. 5, a one-way bypass valve 34 may be provided upstream of the one-way valve 28, between the mask 8 and the pouch 26. Normally the valve 34 is closed to the outside through an outlet 35 so that the gases from the operator's exhalation are directed to and collected in the pouch 26. However, with the valve 34 open to the outside through the outlet 35, the operator can breathe out both to the outside and into the pouch 26. The valve 34 is advantageously open to the outside in the direction shown by the arrow to prevent the operator from breathing in the outside air in case the air is not suitable for breathing. With the valve 34 open to the outside and depending on the pressure within the pouch 26, the operator's exhaled breathe will either flow entirely to the outside through the outlet 35 or portions will flow to the outside and portions will be collected inside the pouch 26. Opening the valve 34 to the outside may be desired when the operator detects some backpressure from the pouch 26 that causes the operator to exert more lung pressure to breathe out. The valve 34 may also be opened in case the valve 28 gets blocked or fails in the closed position. The valve 34 is operable by the operator. The valve 34 may also be connected directly to the mask 8.

Figure 6:
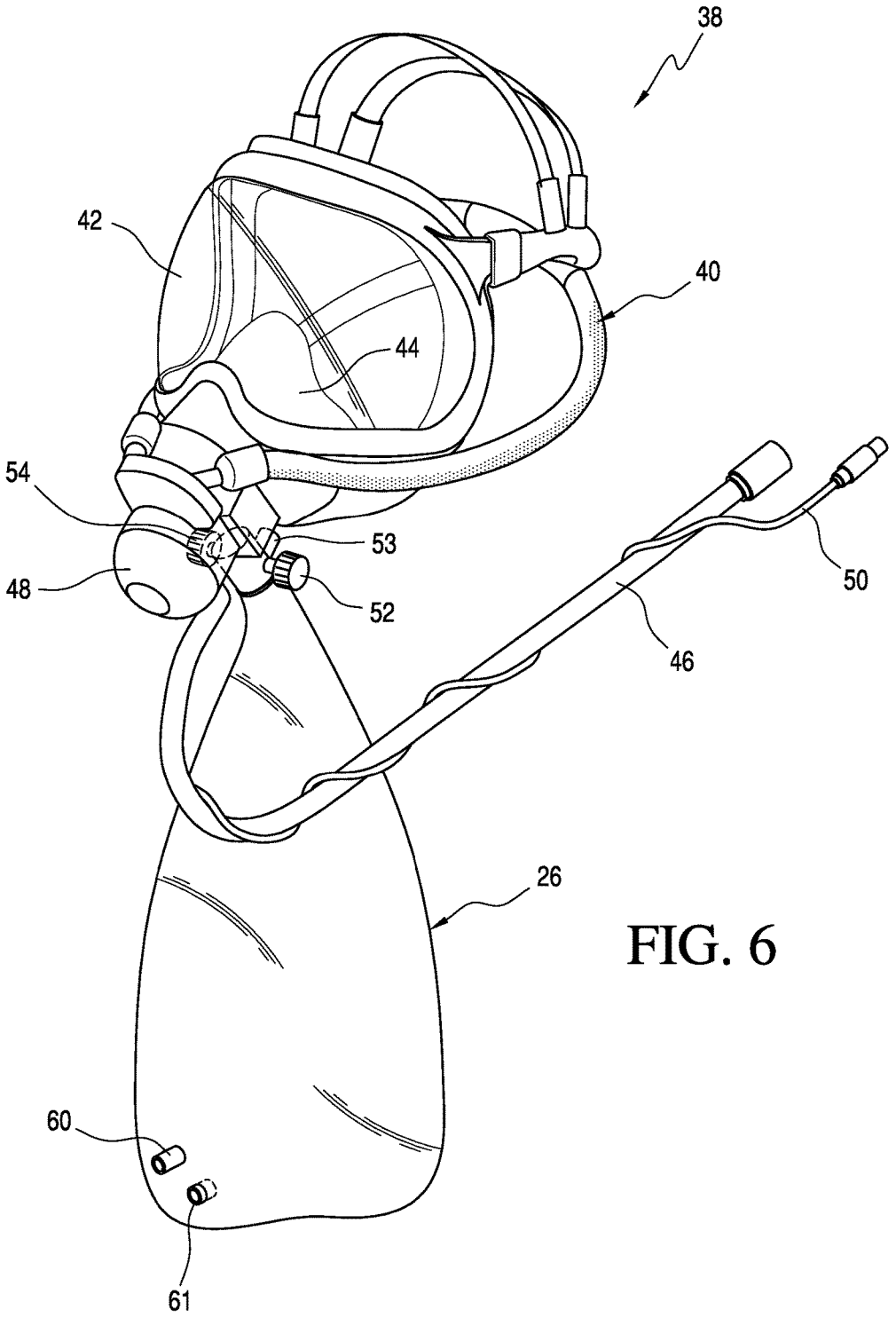
FIG. 6 is perspective view of an oxygen mask made in accordance with the present invention.

Referring to FIG. 6, an oxygen mask 38 made in accordance with the present invention is disclosed. The oxygen mask 38 includes a harness 40 to secure the oxygen mask to the operator's head. A viewing window 42 made of transparent material allows operator to see through the oxygen mask 38. A cup 44 sealingly covers the operator's mouth and nose from the outside air. A flexible tubing 46 in communication with the interior of the cup 44 connects to the oxygen tank supply line from the tank 4 to provide oxygen to the operator. A control knob 48 is used to control the flow of oxygen to the oxygen mask 38. A microphone cord 50 may be provided for communication purposes. The oxygen mask 38 without the pouch 26 is standard construction.

The pouch 26 is operably connected to the cup 44 such that the exhaled gases are collected by the pouch 26 and the gases from the pouch 26 can be inhaled when desired. A control knob 52 is used to open or close the valve 34 to the outside through an outlet 53. When the valve 34 is closed to the outside, gas flow is directed toward the valve 28 into the pouch 26. When the valve 34 is open, gas flow is allowed to the outside through the outlet 53 while at the same time allowing flow through the valve 28 into to the pouch 26. The valve 34 may be omitted, in which case the control knob 52 is not provided. A relief valve 60 provides pressure relief for the pouch 26.

A carbon dioxide sensor 61 may be provided to warn the operator of carbon dioxide buildup inside the pouch 26. The sensor 61 may include a LED indicator that turns on when an unacceptable amount of carbon dioxide is detected. The carbon dioxide sensor can be disposed adjacent the relief valve 60 to detect the amount of carbon dioxide as the gas passes though the valve. In the absence of a carbon dioxide sensor, the provision of an oxygen sensor within or in conjunction with the pouch 26 to warn the user of oxygen depletion is desirable. Such sensors are readily available, for example, from National Draeger Company or the Sierra Monitoring Corporation of California.

A control knob 54 is used to open the normally closed one-way valve 30 to allow gas flow from the pouch 26 to the operator. The knob 54 is operated to open the valve 30 when the operator desires to start breathing from the pouch 26.

Figure 7:
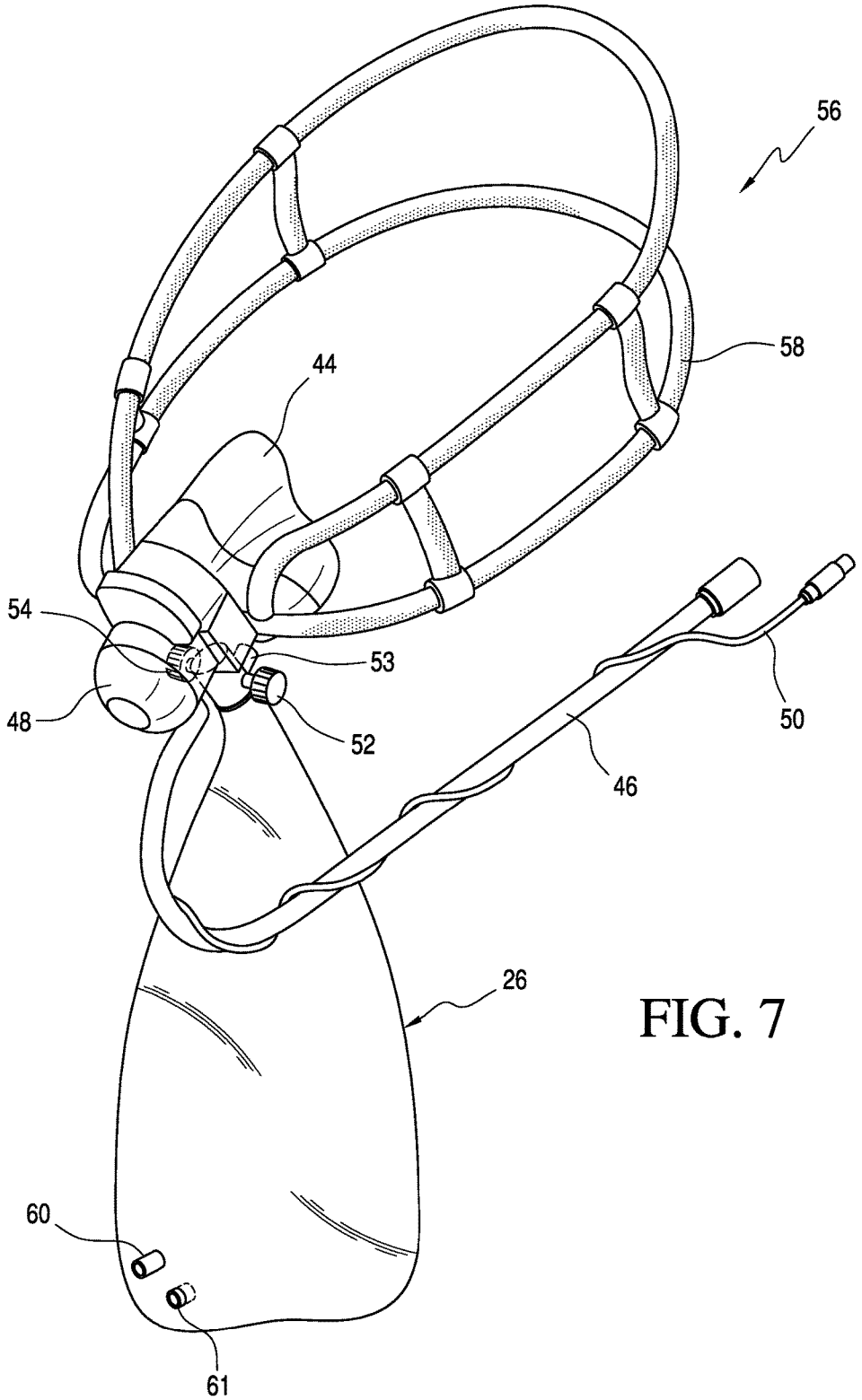
FIG. 7 is a perspective of another embodiment of an oxygen mask made in accordance with the present invention.

Referring to FIG. 7, another embodiment of an oxygen mask 56 is disclosed. The oxygen mask 56 is similar to the oxygen mask 38 except that the viewing window 42 is not provided. A harness 58 is provided to sealingly attach the cup 44 over the operator's mouth and nose. The oxygen mask 56 without the pouch 26 is standard construction. The pouch 26 is operably connected to the cup 44 as described with the oxygen mask 38.

Figure 8:
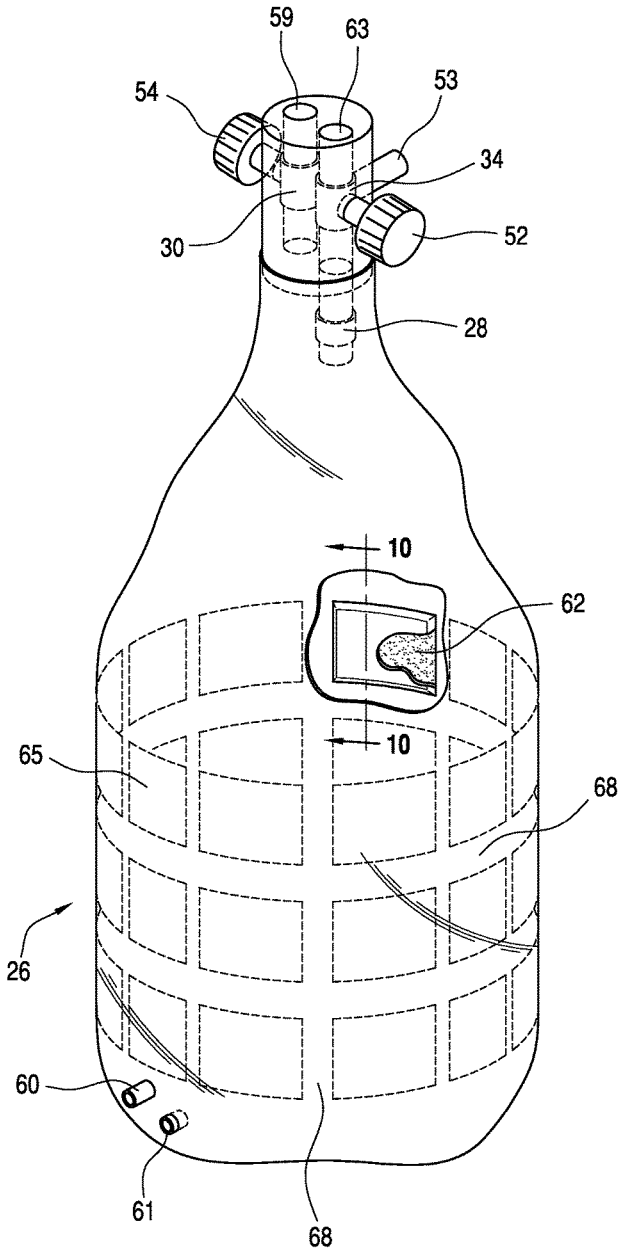
FIG. 8 is a perspective view of an inflated pouch with carbon dioxide scrubber made in accordance with the present invention.

Referring to FIG. 8, passageways 59 and 63 are connected to the cup 44 such that the interior space within the cup 44 communicates with the passageways 59 and 63. When the operator exhales, the exhaled breath flows through passageway 63 and collected within the pouch 26. When the operator inhales, gases from the pouch 26 flows through the passageway 59, if the valve 30 is open, and mixes with the oxygen supplied through the tubing 46 inside the cup 44.

Figure 9:
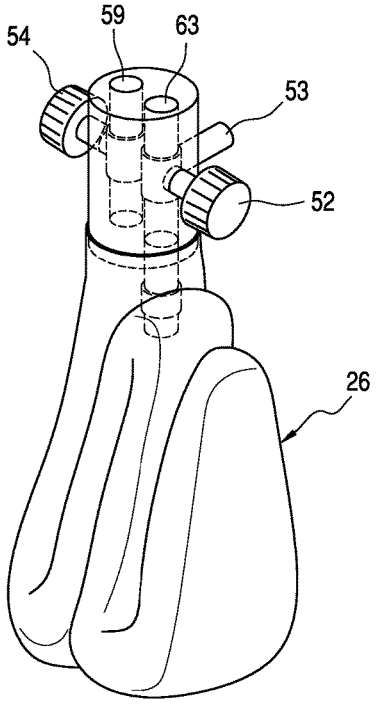
FIG. 9 is the pouch shown in FIG. 8 in a folded position for stowage.

The pouch 26 can be made in any shape when fully inflated, such as bottle-shaped (as shown), spherical, cylindrical, pear-shaped, banana-shaped, water-drop shaped, etc., dictated only by the need to extend the oxygen supply from the tank 4. The pouch 26 may be prepared from gas-impermeable film, which is foldable, as shown in FIG. 9, for stowage. The pouch 26 is inflatable to its maximum volume during use, as shown in FIG. 8, and deflatable and foldable for stowage, as shown in FIG. 9.

Figure 10:
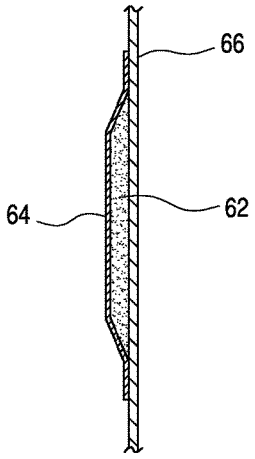
FIG. 10 is a cross-sectional view taken along line 10-10 in FIG. 8.

Referring to FIGS. 8 and 10, carbon dioxide scrubbers 62 in powder form are disposed on the interior of the pouch 26 for contact with the carbon dioxide gas inside the pouch. The carbon dioxide scrubber may be encased in semi-permeable membrane 64 in the form of packets 65 disposed around and attached to the interior sidewall 66 of the pouch 26. The packets 65 are attached to the interior surface of the pouch in any convenient means, including, for example, adhesive bonding to the sidewalls of the pouch. Multiple packets 65 of the carbon dioxide absorber can be conveniently applied on the interior of the pouch in rows and columns with free spaces 68 between each packet 65. Disposing the carbon dioxide scrubbers in packets 65 advantageously allow for folding of the pouch 26 when in stowage. The free spaces 68 between packets advantageously provide flexibility to the pouch 26 for folding for stowage.

A wide variety of carbon dioxide scrubber can be used, including, for example, alkali metal hydroxides and oxides, and sodium carbonate. Of these, the lithium and sodium salts are preferred, and lithium hydroxide in particulate form is particularly preferred. In addition, carbon dioxide scrubber in liquid or gel form can be used.

The membrane 64 preferably has average pore size of about from 10 to 100 microns. This pore size permits contact of the gas and moisture within the pouch with the carbon dioxide scrubber, but prevents the smaller particles of the carbon dioxide scrubber from escaping into the breathing portion of the pouch. The carbon dioxide scrubber is disposed on the interior of the pouch, to bring the carbon dioxide scrubber in contact with the gas within the pouch.

The semi-permeable membrane 64 simultaneously prevents direct inhalation of dust from the carbon dioxide scrubber while permitting contact with the gas inside the pouch. A wide variety of materials can be used, including, for example, various thermoplastic fabrics such as that commercially available from W.L Gore and Associates as "Goretex" expanded fluoropolymer fabric, HEPA Filters and spunbonded materials such as Tyvek (registered trademark), spunbounded fabric and Santora spunbonded fabric. Another particularly desirable semi-permeable membrane for use in the present invention is the product available from Foss Manufacturing Company as OAM-465 fabric. Still another commercially available product is that attainable from Garlock Corporation as Garlock expanded fluoropolymer film.

The carbon dioxide scrubber permits maximum utilization of the available oxygen within the pouch. As an example, a quantity of about from 50 to 500 grams, and preferably about from 75 to 150 grams, of carbon dioxide scrubber may be used. About from 3 to 4 grams of lithium hydroxide are required for removal of carbon dioxide during each minute of closed circuit breathing in an environment of substantially pure oxygen.

The carbon dioxide scrubber permits utilization of available oxygen supply to a far greater extent than would be possible without the carbon dioxide scrubber.

Carbon dioxide scrubbers used with breathing apparatuses are disclosed in U.S. Pat. Nos. 4,627,431; 4,998,529 and 4,683,880, which are all incorporated herein by reference.

A substantially gas-impermeable film is used for the pouch 26 and can include a wide variety of polymeric films, such as polyethylene, polypropylene, polyethylene terephthalate, nylon, polyvinyl chloride, polyurethane, fluoropolymers and polyimides. Heat resistant films are preferred for this application, of which polyimide films are particularly desirable. The exterior surface of the polymeric films used for the present devices can be metalized for further heat reflectivity, using metalizing techniques well known in the art.

In general, the size of the pouch 26 should provide an interior capacity to provide the operator with a sufficient volume of air which, in conjunction with the carbon dioxide scrubber, provides a self-contained air supply that enables comfortable and safe breathing, depending not only on the volume of oxygen or air contained within the pouch but the level of activity of the operator.

Figure 11:
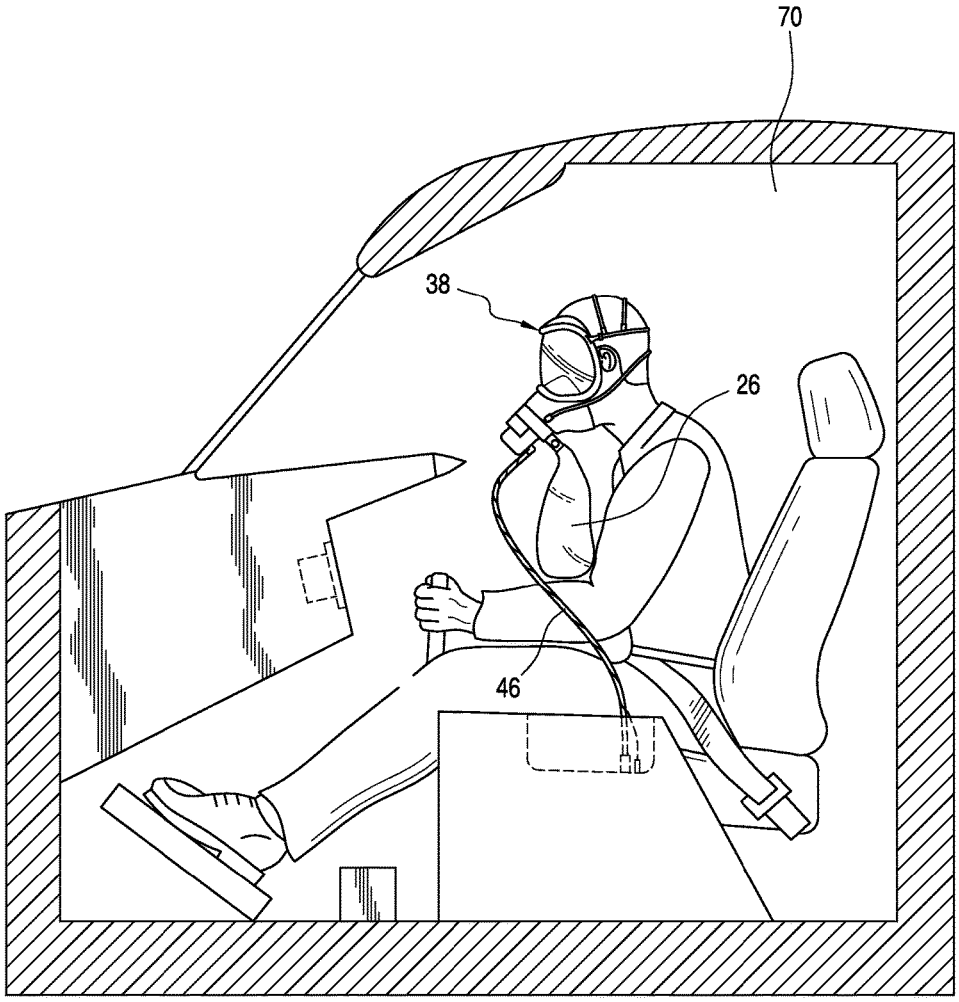
FIG. 11 is a schematic side elevational view of a cockpit showing the oxygen mask of FIG. 6 in use by a pilot during an emergency.

Referring to FIG. 11, the oxygen mask 38 is shown in use inside an aircraft cockpit 70 by a pilot during an emergency requiring use of the oxygen supply of the aircraft. The oxygen mask 38 is connected to the oxygen supply system 2. The pilot exhales into the pouch 26 to capture the unabsorbed oxygen from his lungs. The pilot may regulate the oxygen flow from the system 2 to less than 100% and use the exhaled oxygen from the pouch 26, with the carbon dioxide scrubber reducing the carbon dioxide of the rebreathed gas. By reducing the oxygen flow to less than 100%, the pilot advantageously extends the useful life of the oxygen supply in the tank 4.

The system of the present invention advantageously provides a station operator with a lightweight device that extends the duration of a limited oxygen supply for several minutes. The lightweight construction and simplicity of operation makes the invention particularly useful for airline crew, eliminating the weight and encumbrance of additional oxygen tanks or other complicated systems. The pouch 26 can be safely stored with the oxygen mask for extended periods of time without deterioration of their operating capabilities. However, it is preferred to store the pouch 26 in a sealed container to insulate it from changes in the environmental conditions.

The present invention makes more effective use of the oxygen tank 4 currently in place on commercial aircraft for decompression protection. Moreover, the present invention does not require a pump or pressure source for operation of the carbon dioxide absorber once the pouch has been filled.

Although the oxygen supply system is shown in the context of an aircraft, the invention can be used in other similar environments where an operator in a station requires access to oxygen during a smoke emergency. Examples of operator stations are a submarine control station, a nuclear power plant control room, an oil rig or any other critical or military environments where the need exists for an operator to continue to operate in case of a smoke emergency, such as when smoke or other particulate matter invades the operator station and prevents the operator from breathing the ambient air. Accordingly, where the operator is in a station that requires the operator to continue to man his station, the operator must have access to an oxygen supply in case smoke invades the operator station.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An oxygen supply system for a station operator, comprising:

a) an oxygen cylinder;

b) a mask directly connected to the oxygen cylinder to allow the station operator to inhale oxygen directly from the oxygen cylinder;

c) a pouch operably connected to the mask, the pouch is inflatable during use and deflatable for storage;

d) carbon dioxide scrubber disposed inside the pouch;

e) first one-way valve operably connected between the mask and the pouch for allowing one-way flow of gases exhaled by the station operator from the mask to the pouch; and f) a second one-way valve operably connected between the mask and the pouch for allowing one-way flow of gases from the pouch to the mask, the second one-way valve is controllable by the station operator to be selectively closed to the one-way flow of gases from the pouch to the mask during inhalation to allow the gases exhaled by the station operator to accumulate inside the pouch.

2. The oxygen supply system as in claim 1, wherein the mask includes a viewing window.

3. The oxygen supply system as in claim 1, wherein the pouch is foldable.

4. The oxygen supply system as in claim 1, wherein the pouch is bottle-shaped when fully inflated.

5. The oxygen supply system as in claim 1, wherein the carbon dioxide scrubber is distributed in packets attached to an inside surface of the pouch.

6. The oxygen supply system as in claim 5, wherein the packets are arranged in rows with space between the packets.

7. The oxygen supply system as in claim 1, and further comprising:

a) a bypass valve connected upstream of the first one-way valve; and b) the bypass valve is normally closed to the outside and open toward the pouch.

8. The oxygen supply system as in claim 7, wherein the bypass valve is operable to an open position to the outside to divert gas flow to the outside.

9. The oxygen supply system as in claim 1, wherein the second one-way valve includes a closed position for blocking flow from the pouch to the mask and an open position for allowing flow from the pouch to the mask.

10. The oxygen supply system as in claim 1, wherein the pouch includes a carbon dioxide sensor.

11. The oxygen supply system as in claim 1, wherein the mask includes a control knob for varying the amount of oxygen provided to the station operator.

12. The oxygen supply system as in claim 1, wherein the carbon dioxide scrubber includes lithium hydroxide.

13. An oxygen mask, comprising:

a) a cup for sealing attachment over a user's mouth and nose, the cup is configured for direct connection to an oxygen supply to allow the user to inhale oxygen directly from the oxygen supply;

b) a pouch operably connected to the cup, the pouch is inflatable during use and deflatable for storage;

c) carbon dioxide scrubber disposed inside the pouch;

d) a first one-way valve operably connected between the cup and the pouch for allowing one-way flow of gases exhaled by the user to the pouch; and e) a second one-way valve operably connected between the cup and the pouch for allowing one-way flow of gases from the pouch to the cup, the second one-way valve is controllable by the user to be selectively closed to the one-way flow of gases from the pouch to the cup during inhalation to allow the gases exhaled by the user to accumulate inside the pouch.

14. The oxygen mask as in claim 13, wherein the pouch is foldable.

15. The oxygen mask as in claim 13, wherein the pouch is bottle-shaped when fully inflated.

16. The oxygen mask as in claim 13, wherein the carbon dioxide scrubber is distributed in packets attached to an inside surface of the pouch.

17. The oxygen mask as in claim 16, wherein the packets are arranged in rows with space between the packets.

18. The oxygen mask as in claim 13, and further comprising:

a) a bypass one-way valve operably connected to the cup; and b) the bypass one-way valve is normally closed to the outside and open toward the pouch.

19. The oxygen mask as in claim 18, wherein the bypass one-way valve is operable to an open position to the outside to divert exhaled gas flow from user to the outside.

* * * * *